United States Patent [19]

Kaji

[11] Patent Number: 5,009,153

[45] Date of Patent: Apr. 23, 1991

[54] DEVICE AND METHOD FOR BUNDLING

[76] Inventor: Joel T. Kaji, 27519 Gateway N., #204, Farmington Hills, Mich. 48018

[21] Appl. No.: 482,189

[22] Filed: Feb. 20, 1990

[51] Int. Cl.[5] ..... B65B 13/02

[52] U.S. Cl. ..... 100/2; 100/9; 100/34

[58] Field of Search ..... 100/1-3, 100/34, 9

[56] References Cited

U.S. PATENT DOCUMENTS

| | | | |
|---|---|---|---|
| 1,882,343 | 10/1932 | Troth | 100/34 X |
| 2,636,432 | 4/1953 | Sherer | 100/34 |
| 3,038,403 | 6/1962 | Orelind | 100/34 |
| 3,145,646 | 8/1964 | Levy | 100/34 |
| 3,780,854 | 12/1973 | Ruppenthal | 100/34 X |
| 3,964,381 | 6/1976 | Coenen | 100/34 |
| 4,150,612 | 4/1979 | Kessler | 100/34 X |
| 4,603,542 | 8/1986 | Reiter et al. | 100/9 X |
| 4,681,032 | 7/1987 | McDermott | 100/34 |

FOREIGN PATENT DOCUMENTS

| | | | |
|---|---|---|---|
| 3520650 | 12/1986 | Fed. Rep. of Germany | 100/1 |
| 564463 | 7/1975 | Switzerland | 100/34 |
| 954333 | 9/1982 | U.S.S.R. | 100/2 |

*Primary Examiner*—Harvey C. Hornsby
*Assistant Examiner*—Stephen F. Gerrity
*Attorney, Agent, or Firm*—Brooks & Kushman

[57] ABSTRACT

A bundling device (10) is disclosed as having a tie assembly (12) and a receptacle (14). The tie assembly includes a seat member (16), a drawband (18), and a plurality of ties (22) each having one end attached to the seat member and another end slidably attached to the drawband. The receptacle includes a tray (24) having a horizontal bottom (24) to support the seat member and sides (26) extending upwardly from the bottom to maintain the drawband in an open, generally horizontal loop spaced above the seat member. Items, such as newspapers, placed into the bundling device such that they rest upon the seat member, between the ties, and below the drawband, are bound by pulling upwardly on the drawband at two points separated by at least one tie, thereby forming two elongated loops in portions of the drawband and simultaneously and equally tightening the ties about the items, and tying the two elongated loops together.

16 Claims, 2 Drawing Sheets

DEVICE AND METHOD FOR BUNDLING

TECHNICAL FIELD

This invention relates to bundling devices that bind and secure, with tightenable ties, stacked newspapers and similar items.

BACKGROUND ART

Bundling devices have been known for many years; for example, U.S. Pat. No. 3,780,854 to Ruppenthal discloses a paper storage and baling container that includes a board member atop which once-folded newspapers and similar items are stacked. Baling strands of predetermined lengths are attached to the board member to bind a stack of newspapers thereto and thus form a bale or bundle. A holder in the form of a rectangular cylinder is also provided to serve as a guide when newspapers are being stacked onto the board member.

The Ruppenthal device for baling paper represents an improvement in the efficiency of previous devices in that it provides a substantially rigid board member upon which newspapers may be stacked and to which they may be bound and also provides a holder to facilitate stacking the newspapers. Its effectiveness, however, remains limited by the fact that each baling strand must be loosed from a holding position on the board member, threaded through a slot in an upper portion of the holder prior to newspapers being stacked on the board member, withdrawn from the slot prior to binding the newspapers, and individually tied to an opposingly disposed baling strand.

A number of other patents generally disclose bundling devices that support a stack of items or a package for binding with string or other suitable elongated ties. In addition to supporting the items to be bound, the bundling devices also support precut lengths or spools of string to bind the items. Examples of these devices are disclosed in U.S. Pat. No's. 4,681,032; 4,150,612; 3,145,646; 3,038,403; and 2,636,432.

While each of these bundling devices functions with a certain degree of efficiency, none have the advantages of the improved bundling device of the present invention as is hereinafter more fully described.

DISCLOSURE OF INVENTION

An object of the present invention is to provide an improved bundling device that simultaneously applies equal tension to all ties used to bundle items and to provide convenient means for securing the tightened ties.

Another object of the present invention is to provide an improved bundling device that combines a tie assembly and a receptacle to support the tie assembly and within which to store items to be bundled.

Yet another object of the present invention is to provide an improved bundling device that simultaneously and conveniently controls the disposition of all ties and maintains them in positions that do not interfere with the insertion of items to be bundled and that is otherwise simple and efficient to operate.

In realizing the aforementioned and other objects, the bundling device of the present invention includes a tie assembly and a receptacle. The tie assembly includes a seat member, a drawband forming a closed loop, a drawband tube substantially enclosing the drawband and through which the drawband is free to slide, and a plurality of ties, each tie having a base end attached to the seat member and a draw end forming a loop slidably encircling one thickness of the drawband tube. The drawband tube has at least two lateral openings through which portions of the drawband can be withdrawn, the loop in the draw end of at least one tie encircling the drawband tube between at least two openings in the drawband tube.

The receptacle includes a tray having a horizontal bottom to support the seat member and further having sides extending upwardly from the bottom. The sides maintain the drawband in an open, generally horizontal loop spaced above the seat member to allow items to be stacked upon the seat member, between the ties, and below the drawband.

The bundling device also includes a plurality of catches, each catch being mounted on an uppermost portion of a side and being spaced from each other catch. The catches engage the drawband tube to aid in maintaining the drawband in an open, generally horizontal loop spaced above the seat member.

The objects, features and advantages of the present invention are readily apparent from the following detailed description of the best mode for carrying out the invention when taken in connection with accompanying drawings.

BRIEF DESCRIPTION OF DRAWINGS

In the drawings, in which like reference characters indicate corresponding parts in all the views.

BEST MODE FOR CARRYING OUT THE INVENTION

Figure 1:
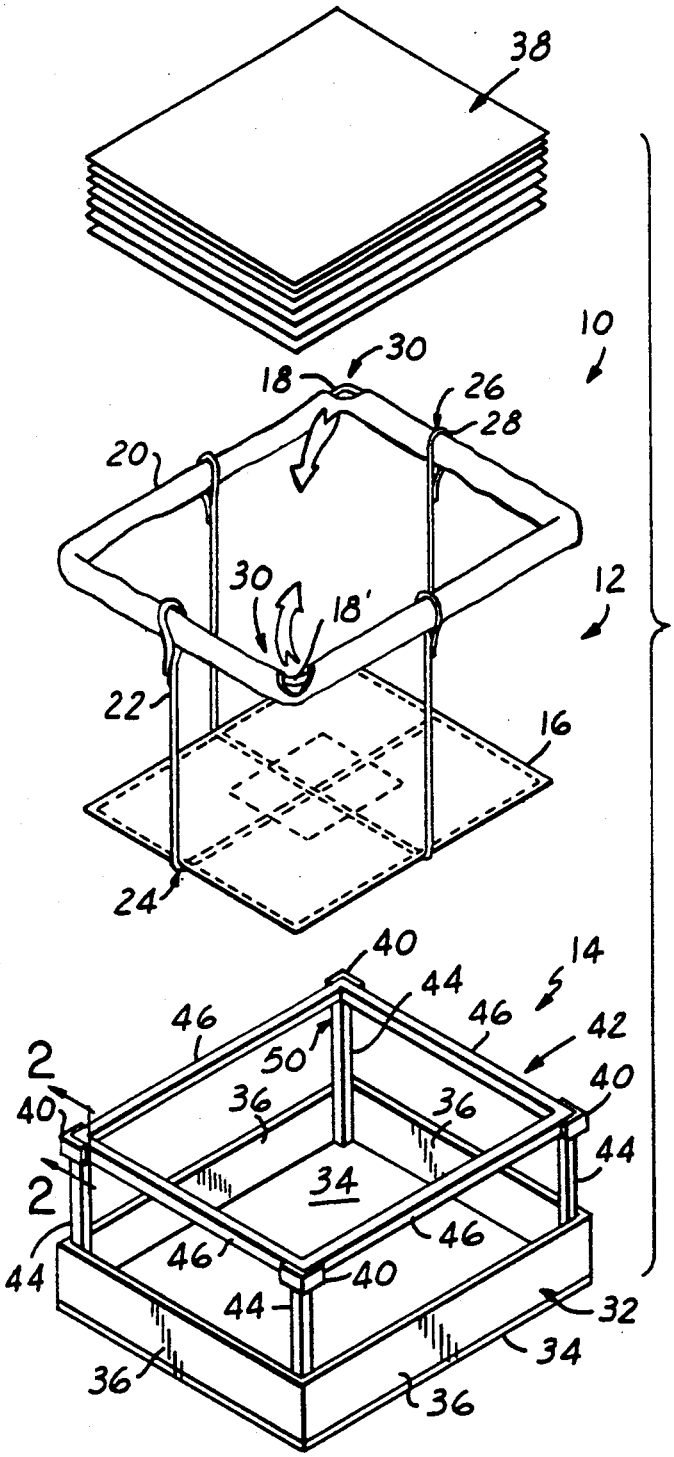
FIG. 1 is a perspective view illustrating the bundling device of the present invention.

With reference to FIG. 1 of the drawings, the bundling device generally indicated by the reference numeral 10 includes two major parts, a tie assembly 12 and a receptacle 14. The tie assembly 12 includes a seat member 16, a drawband 18 forming a closed loop, a drawband tube 20 substantially enclosing the drawband 18 and through which the drawband is free to slide, and a plurality of ties 22, each tie having a base end 24 attached to the seat member 16 and a draw end 26 forming a loop 28 slidably encircling one thickness of the drawband tube 20. The drawband tube 20 has at least two lateral openings 30 through which portions of the drawband 18 can be withdrawn, the loop 28 in the draw end 26 of at least one tie 22 encircling the drawband tube 20 between at least two openings 30 in the drawband tube 20.

The receptacle 14 includes a tray 32 having a horizontal bottom 34 to support the seat member 16 and having sides 36 extending upwardly from the bottom 34. The sides 36 participate in maintaining the drawband 20 in an open, generally horizontal loop spaced above the seat member 16 to allow items, generally indicated by the reference numeral 38, to be stacked upon the seat member 16, between the ties 22, and below the drawband tube 20. The sides 36 also serve as guides while items 38 are being stacked onto the seat member 16.

In the preferred embodiment of the bundling device 10, the receptacle 14 further includes a frame 42 disposed above the tray 32. The frame 42 has a plurality of vertical frame members 44 and horizontal frame members 46. Each vertical frame member 44 has a lower portion 48 attached to and supported by the tray 32. Each vertical frame member 44 also has an upper portion $o attached to and supporting the horizontal frame members 46.

Figure 2:
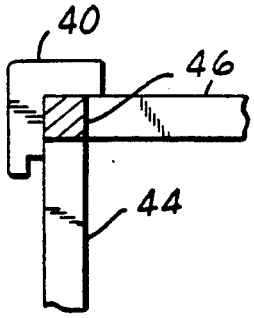
FIG. 2 is a sectional, fragmentary view illustrating an element of the invention.

The receptacle 14 also includes a plurality of catches 40, illustrated in detail by FIG. 2 of the drawings, each being mounted on an uppermost portion of the frame 42 and being spaced from every other catch 40. The catches 40 engage the drawband tube 20 to aid in maintaining it in an open, generally horizontal loop spaced above the seat member 16. In the preferred embodiment of the bundling device 10, the seat member 16 is rectangular in its horizontal plane and has horizontal dimensions substantially approximating those of a typical, once-folded newspaper 38. The base end 24 of a tie 22 is attached to the rectangular seat member 16 proximate the midpoint of each of the four edges thereof. Of course, ties 22 on opposing sides of the seat member 16 may be made in one continuous piece.

The bottom 34 of the tray 32 is also rectangular in its horizontal plane; and a side 36 extends upwardly at right angles from each of the four edges of the bottom 34, the sides 36 forming orthogonal corners at their lines of intersection. The bottom 34 has horizontal dimensions sufficiently greater than respective dimensions of the seat member 16 to allow the seat member and newspapers 38 stacked thereon to be lowered onto the bottom 34 with no interference from the sides 36.

The frame 42 is rectangular in its horizontal and vertical planes and is constructed of four vertical frame members 44 and four horizontal frame members 46. Each vertical frame member 44 has a lower portion 48 attached to and supported by the tray 32 at each corner formed by the intersection of two sides 36. Each horizontal frame member 46 is attached at each of its ends to another horizontal frame member 46 to form a horizontal rectangle. Each vertical frame member 44 has an upper portion 50 attached to and supporting two horizontal frame members 46 at one corner of the rectangle formed by the horizontal frame members 46. A catch 40 is located at each of the four corners of the horizontal rectangle formed by the horizontal frame members 46.

Figure 3:
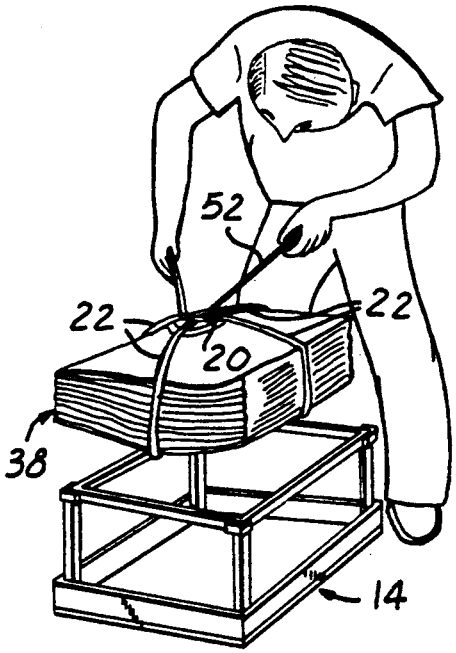
FIG. 3 is a perspective view illustrating an application of the bundling device.
Figure 4:
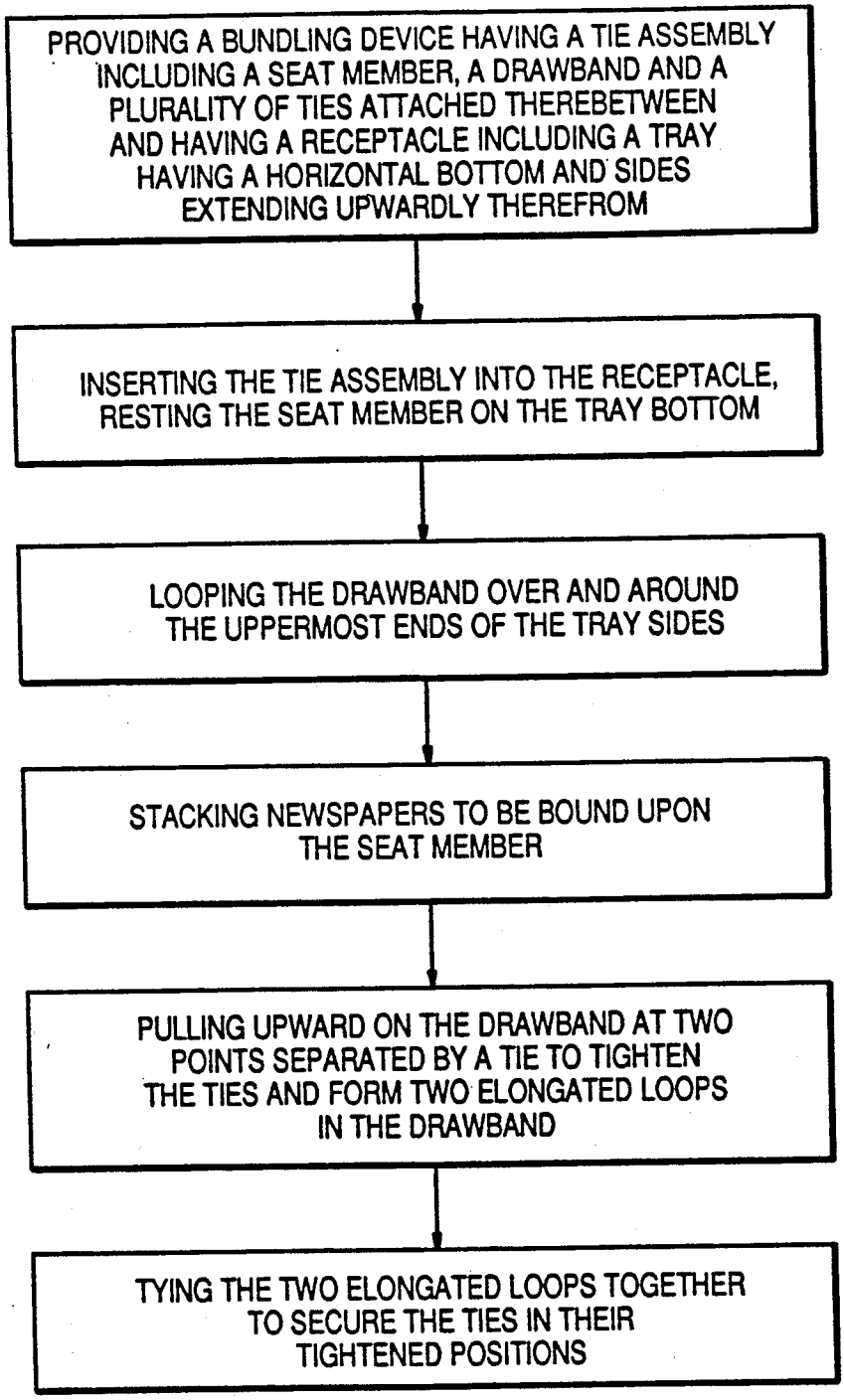
FIG. 4 is a flow chart illustrating the steps in a method for using the bundling device.

As indicated by FIG. 4, and with reference to FIGS. 1 through 3, to operate the bundling device 10, a tie assembly 12 is placed into the receptacle 14 such that the seat member 16 Of the tie assembly 12 rests on the bottom 34 of the receptacle 14. The drawband tube 20 is pulled upwardly and positioned around the outside periphery of the frame 42. The drawband tube 20 is then engaged with the catches 40 at the upper corners of the frame 42 to maintain the drawband tube 20 in an open, generally horizontal, rectangular loop spaced above the seat member 16 and to maintain the ties 22 in a generally vertical disposition proximate the sides 36 of the tray 32.

Newspapers 38, or similar items, are stacked upon the seat member 16, between opposite ties 22, and below the drawband tube 20. Portions of the drawband 18 are withdrawn from the drawband tube 20 through two lateral openings 30. With reference to FIG. 3 of the drawings, as the portions of the drawband 18 are pulled from the drawband tube 20, the latter is accordioned, reducing its effective circumference. This, in turn, simultaneously and equally tightens the ties 22 about the newspapers 38. The two withdrawn portions of the drawband 18 form elongated loops 52, as illustrated by FIG. 3 of the drawings, and these are fastened together to secure the ties 22 in their tightened positions.

In an alternate embodiment, a pair of drawbands 18 are slidably disposed within the drawband tube 20. A portion of one drawband 18 is withdrawn through one of the lateral openings 30 in the drawband tube 20, and a portion of the other drawband 18 is withdrawn through the other opening. As in the previously described embodiment, as the portions of the drawbands 18 are pulled from the drawband tube 20, the latter is accordioned, reducing its effective circumference. This, in turn, simultaneously and equally tightens the ties 22 about the newspapers 38. The withdrawn portion of each drawband 18 forms an elongated loop 52, and these are fastened together to secure the ties 22 in their tightened positions.

It should be understood that the tie assembly and the receptacle may be constructed in a number of shapes and sizes to accommodate a variety of items for binding. The parts may be made of a variety of materials, including wood, plastic and metal and may be formed to make them decorative as well as functional so that the tie assembly can be used in an area exposed to guests to store newspapers until enough are collected for bundling. Each material used to make the bundling device has its own particular advantages and disadvantages; for example, if it is formed of plastic, it may be light and strong. If plastic material is used, it is of the typical biodegradable type. Additionally, many of its components, such as the ties, may be attached by heat bonding or molded as one piece.

While the best mode for carrying out the invention has been described in detail, those familiar with the art to which this invention relates will recognize various alternative designs and embodiments for practicing the invention as disclosed by the following claims.

What is claimed is:

1. A bundling device for binding a stack of items, such as newspapers, the bundling device comprising:

a tie assembly including a drawband forming a closed loop and further including a plurality of ties, each tie having a base end attached to the base end of at least one other tie and a draw end forming a loop slidably encircling one thickness of the drawband; and a receptacle including a tray having a horizontal bottom to support the base ends of the ties the stack of items and further having sides extending upwardly from the bottom to maintain the drawband in an open, generally horizontal loop spaced above the bottom to allow items to be stacked upon the base ends of the ties as they rest on the bottom, between the ties, and below the drawband so that an upward pull on the drawband at two points separated by at least one tie thereby simultaneously tightens the ties about the items and forms, of two respective portions of the drawband, elongated loops that may be fastened together to secure the ties in their tightened positions.

2. The bundling device of claim 1, wherein the tie assembly further includes a drawband tube substantially enclosing the drawband and through which the drawband is free to slide, the drawband tube having at least two lateral openings through which portions of the drawband can be withdrawn from the drawband tube, the loop formed in the draw end of each tie slidably encircling one thickness of the drawband tube, the loop in the draw end of at least one tie encircling the drawband tube between the at least two openings in the drawband tube.

3. The bundling device of claim 2, wherein the tie assembly further includes a horizontally disposed seat member attached to the base ends of the ties, the seat member being supported by the bottom of the receptacle when the tie assembly is inserted therein and being supported by the ties when the tie assembly is lifted out of the receptacle.

4. The bundling device of claim 3, wherein the receptacle further includes a plurality of catches, each catch being mounted on an uppermost portion of a side and being spaced from each other catch, to aid in maintaining the drawband tube in an open, generally horizontal loop spaced above the seat member.

5. The bundling device of claim 3, wherein the receptacle further includes a frame disposed above the tray, the frame having a plurality of vertical frame members and at least one horizontal frame member, each vertical frame member having a lower portion thereof attached to and being supported by the tray and having an upper portion thereof attached to and supporting at least one horizontal frame member.

6. The bundling device of claim 5, wherein the receptacle further includes a plurality of catches, each catch being mounted on an uppermost portion of the frame and being spaced from each other catch, to aid in maintaining the drawband in an open, generally horizontal loop spaced above the seat member.

7. The bundling device of claim 6, wherein the bottom, sides, vertical frame members, horizontal frame members and catches of the receptacle are formed of plastic material.

8. The bundling device of claim 7, wherein the plastic material is biodegradable.

9. The bundling device of claim 7, wherein the base ends of the ties are heat bonded to the seat member; and the draw end of each tie is heat bonded to an adjacent portion of the tie to form the loop therein.

10. A bundling device for binding a stack of newspapers, the bundling device comprising:

a tie assembly including a seat member, the seat member being rectangular in its horizontal plane and having horizontal dimensions substantially approximating those of a typical, once-folded newspaper; a drawband forming a closed loop; and a plurality of ties, each tie having a base end attached to the seat member and a draw end forming a loop slidably encircling one thickness of the drawband; and a receptacle including a tray and a frame, the tray having a horizontal bottom to support the seat member and further having four sides extending normally upward from the bottom, the bottom being rectangular in its horizontal plane and having horizontal dimensions sufficiently greater than respective dimensions of the seat member to allow the seat member and newspapers stacked thereon to be lowered onto the bottom with no interference from the sides, the frame being rectangular in its horizontal and vertical planes and having four vertical frame members and four horizontal frame members, each vertical frame member having a lower portion thereof attached to and being supported by the tray at the intersection of two of the sides, each horizontal frame member being attached at each of its ends to an unattached end of another horizontal frame member to form a horizontal rectangle, each vertical frame member having an upper portion thereof attached to and supporting two horizontal frame members at one corner of the rectangle formed at the intersection of two horizontal frame members, the frame maintaining the drawband in an open, generally horizontal loop spaced above the seat member to allow newspapers to be stacked upon the seat member, between the ties, and below the drawband so that an upward pull on the drawband at two points separated by the loop in the draw end of at least one tie thereby simultaneously and equally tightens the ties about the newspapers and forms, of two respective portions of the drawband, elongated loops that may be fastened together to secure the ties in their tightened positions.

11. The bundling device of claim 10, wherein the tie assembly further includes a drawband tube substantially enclosing the drawband and through which the drawband is free to slide, the drawband tube having at least two lateral openings through which portions of the drawband can be withdrawn from the drawband tube, the loop formed in the draw end of each tie slidably encircling one thickness of the drawband tube, the loop in the draw end of at least one tie encircling the drawband tube between the at least two openings in the drawband tube.

12. The bundling device of claim 11, further including a plurality of catches, each catch being mounted on an uppermost portion of the frame and being spaced from each other catch, to aid in maintaining the drawband tube in an open, generally horizontal loop spaced above the seat member.

13. The bundling device of claim 12, wherein the bottom, sides, vertical frame members, horizontal frame members and catches of the receptacle are formed of plastic material.

14. The bundling device of claim 13, wherein the plastic material is biodegradable.

15. The bundling device of claim 13, wherein the base ends of the ties are heat bonded to the seat member; and the draw end of each tie is heat bonded to an adjacent portion of the tie to form the loop therein.

16. A method for binding a stack of items, such as newspapers, the method comprising the steps of:

providing a bundling device having a tie assembly including a seat member, a drawband forming a closed loop, and a plurality of ties, each tie having a base end attached to the seat member and a draw end forming a loop slidably encircling one thickness of the drawband, and having a receptacle including a tray having a horizontal bottom to support the seat member and further having sides extending upwardly from the bottom;

inserting the tie assembly into the receptacle so that the seat member of the tie assembly rests upon the bottom of the receptacle;

forming the drawband into a generally horizontal loop disposed above the bottom and outside the receptacle, the ties being draped over the sides, thereby supporting the drawband;

stacking the items to be bound upon the seat member;

pulling upwardly on the drawband at two points separated by the loop in the draw end of at least one tie, thereby simultaneously and equally tightening the ties about the stacked items and forming, of two respective portions of the drawband, elongated loops; and tying the two elongated loops together to secure the ties in their tightened positions.

* * * * *